US006409319B1

(12) United States Patent
Taneya et al.

(10) Patent No.: US 6,409,319 B1
(45) Date of Patent: Jun. 25, 2002

(54) LIQUID DISCHARGE HEAD, LIQUID DISCHARGE APPARATUS AND LIQUID DISCHARGING METHOD

(75) Inventors: Yoichi Taneya, Kanagawa; Hiroyuki Ishinaga; Yoshinori Misumi, both of Tokyo; Hiroyuki Sugiyama, Kanagawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/916,471

(22) Filed: Jul. 30, 2001

(30) Foreign Application Priority Data

Jul. 31, 2000 (JP) ..... 2000-232412

(51) Int. Cl.[7] ..... B41J 2/05
(52) U.S. Cl. ..... 347/65
(58) Field of Search ..... 347/63, 65, 67, 347/20, 56, 61

(56) References Cited

U.S. PATENT DOCUMENTS 4,723,129 A 2/1988 Endo et al. ..... 347/56
5,821,962 A * 10/1998 Kudo et al. ..... 347/64

FOREIGN PATENT DOCUMENTS

EP 0813967 12/1997 ..... B41J/2/14
EP 0976561 2/2000 ..... B41J/2/14
EP 0982136 3/2000 ..... B41J/2/14
EP 1072419 1/2001 ..... B41J/2/14
JP 62181 2/2000 ..... B41J/2/05
JP 62183 2/2000 ..... B41J/2/05

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge head comprises a heating element which heats liquid in a liquid flow path to produce a bubble in the liquid, a discharge port through which liquid is discharged by pressure involved in bubble growth, the discharge port communicating with the lower part of the liquid flow path and being smaller in the area of a cross section at right angles to the direction of liquid introduction than the liquid flow path, a movable member which is provided like a cantilever in the liquid flow path, the free end of the member being positioned on the side of the discharge port, and a restrictor which substantially closes the upper part of the liquid flow path by being substantially brought into contact with the movable member when the movable member is displaced by the growth of the bubble, wherein a meniscus is in the discharge port when due to bubble breakage, the movable member moves from the normal position in such a direction that the liquid flow path is open widely and then returns to the normal position.

7 Claims, 9 Drawing Sheets

CHANGING POINT

CHANGING POINT

CHANGING POINT

CHANGING POINT

LIQUID DISCHARGE HEAD, LIQUID DISCHARGE APPARATUS AND LIQUID DISCHARGING METHOD

BACKGROUND OF THE INVENTION

1. Field of the Invention

The present invention relates to a liquid discharging method, a liquid discharge head, and a liquid discharge apparatus which discharge a desired liquid using bubbles formed by acting thermal energy on the liquid. The present invention relates especially to a liquid discharging method, a liquid discharge head, and a liquid discharge apparatus which use a movable member relying on bubbles in moving.

The present invention can be used for printers which make records on recording media made of paper, threads, fibers, fabric, leather, metal, plastic, glass, wood, ceramics, etc.; copying machines; fax machines with a communications system; word processors with a printer; and industrial recorders which are combined with various equipment.

In this specification, the term "recording" means to print not only a meaningful image, such as a letter or a figure, but a meaningless image, such as a pattern, on a recording medium.

2. Related Background Art

An ink jet recording method, a so-called bubble jet recording method, is known which forms an image by ejecting ink through a discharge port against a recording medium using a force caused by an ink state change due to energy, such as heat, given to ink, which change is accompanied by a rapid volume change (bubble formation). As disclosed in U.S. Pat. No. 4,723,129, a recorder using such a method commonly has a discharge port through which ink is discharged, an ink flow path which communicates with the discharge port, and an electricity-heat converter which is means for generating energy for discharging ink disposed in the path.

Such a recording method allows a high-quality image to be formed fast with low noise. In addition, because a head using such a method allows ink mainly discharge ports to be densely disposed, an image with high resolution and furthermore a color image can easily be provided by a small apparatus. For these reasons, the bubble jet recording method has recently been used for a variety of office equipment, including printers, copying machines, fax machines, and even industrial systems, such as textile printing machines.

Such a liquid discharge head is known which has a movable member and a stopper. Like a cantilever, the movable member is supported on a bearing upstream of a heating element (opposite to a discharge port), and the free end of the member is positioned downstream of the element (on the discharge port side). In contact with the movable member, the stopper substantially closes the upper part of an ink flow path when the movable member moves as bubbles grow.

In the liquid discharge head, the movable member moves, coming into substantial contact with the stopper to substantially close the upper part of the ink flow path when the heating element produces bubbles. Thus, energy generated by bubbling is used efficiently for ink discharge.

Immediately after a bubble grows to a maximum size and then starts to shrink, the upper part of the ink flow path remains substantially closed, so that ink mainly flows from the discharge port toward the bubble (upstream). Thus ink droplets are rapidly separated from ink in the liquid discharge head and discharged properly.

As the bubble shrinks, an ink flow and the inertia of the movable member cause the member to move to a position where the member opens the ink flow path more widely than when it is in the normal position. Because of this, the flow resistance of the upper part of the ink flow path temporarily decreases to a great extent, so that the head can rapidly be refilled with ink.

When the movable member returns to the normal position finally, the resistance of the upper part of the ink flow path becomes relatively, thus restricting an ink refilling flow. Thus a meniscus formed due to the inertia of the flow can be prevented from moving downstream to excess and vibrating.

SUMMARY OF THE INVENTION

As described above, a liquid discharge head with a movable member and a stopper can discharge ink at short time intervals and be driven at a high frequency because the head can rapidly be refilled with ink without meniscus vibration.

Japanese Patent Application Laid-Open No. 2000-62181 and No. 2000-62183 and the like disclose the relationship between the operating condition of a movable member and discharge timing which allows ink to be discharged properly, which relationship is observed when a liquid discharge head is driven at a high frequency. That is, these documents say that providing the next ink discharge when a movable member is in a specific operating condition inhibits ink droplets from being divided into main droplets and auxiliary droplets (satellites) and allows bubbling energy to be efficiently used for ink discharge.

However, the relationship between the behavior and position of a meniscus, which is closely related to record quality, and discharge timing has not yet been disclosed clearly.

It is an object of the present invention to provide a liquid discharge head which can be driven properly at high speed, a liquid discharging method, and a liquid discharge apparatus by appropriately specifying the relationship between the behavior and position of a meniscus and discharge timing, the structure of an ink flow path, and especially the relationship between the path and orifice plate thickness.

To attain the objective, a liquid discharge head according to the present invention having a heating element which heats liquid in a liquid flow path to produce a bubble in liquid; a discharge port through which liquid is discharged by pressure involved in bubble growth, the discharge port communicating with the lower part of the liquid flow path and being smaller in the area of a cross section at right angles to the direction of liquid introduction than the liquid flow path; a movable member which is provided like a cantilever in the liquid flow path, the free end of the member being positioned on the side of the discharge port; and a restrictor which substantially closes the upper part of the liquid flow path by being substantially brought into contact with the movable member when the movable member is displaced by the growth of the bubble, wherein a meniscus is in the discharge port when due to bubble breakage, the movable member moves from the normal position in such a direction that the liquid flow path is open widely and then returns to the normal position.

When the movable member moves from the normal position to the side of the heating element due to bubble breakage, a liquid discharge head, which has a movable member and a restrictor, is rapidly refilled with liquid, so that a liquid meniscus dashes back to the discharge port. When the meniscus does so, the orifice plate and nozzle may shift with respect to each other due to workmanship variations, or a liquid flow may not be uniform on a cross section at right angles to the direction of liquid introduction, depending on the position of the restrictor or movable member, so that the meniscus inclines. If the next liquid discharge is performed with the meniscus inclined, the direction of liquid discharge drifts, thus degrading a recorded image.

The inventors found that if the meniscus goes back into the discharge port, the effect of the inclination of the meniscus is substantially eliminated. This is due to the fact that the inclination of the meniscus in the discharge port is negligible because of the relatively small area of that cross section of the discharge port which is at right angles to the direction of liquid introduction. Thus if a liquid discharge head is designed so that the movable member moves from the normal position to the heating element side for the meniscus to go back into the discharge port while the head is refilled with liquid relatively fast, the next liquid discharge can properly be performed immediately after refilling, and liquid can be sequentially discharged at short time intervals.

A liquid discharge head according to the present invention is further adapted so that when liquid is discharged, the position of the meniscus significantly varies and that then the rate of positional variation sharply decreases, starting at a certain position when the meniscus is in the discharge port. It is desirable that the liquid discharge head have means for controlling the heating element and that the means controls the heating element so that the next liquid discharge is performed by the time that the meniscus reaches the liquid discharge surface after the rate of positional variation sharply changes.

A liquid discharge apparatus according to the present invention includes such a liquid discharge head as described above and recording medium conveying means for conveying a recording medium which receives liquid discharged from the liquid discharge head.

A liquid discharge apparatus according to the present invention can preferably be used for an apparatus which makes records by discharging liquid from a liquid discharge head to attach ink to a recording medium.

A liquid discharging method according to the present invention, comprising the steps of producing a bubble in liquid by heating it, moving a cantilever-like movable member in the path from the normal position as the bubble grows, substantially closing the upper part of a liquid flow path when the bubble attains the maximum volume, discharging liquid through a discharge port which is smaller in the area of a cross section at right angles to the direction of liquid introduction than the liquid flow path, and returning the movable member to the normal position when the bubble breaks after liquid is discharged, wherein a meniscus is in the discharge port when the movable member returns to the normal position after the member moves from the normal position to the heating element side due to bubble breakage, and the next liquid discharge is performed during the period from the time when the movable member returns to the normal position to the time when the meniscus reaches the liquid discharge surface.

A liquid discharging method according to the present invention is still further adapted so that when liquid is discharged, the position of the meniscus significantly varies, that then the rate of positional variation sharply decreases, starting at a certain position when the meniscus is in the discharge port, and that the next liquid discharge is performed by the time that the meniscus reaches the liquid discharge surface after the rate of positional variation sharply changes.

DESCRIPTION OF THE PREFERRED EMBODIMENTS

Figure 1:
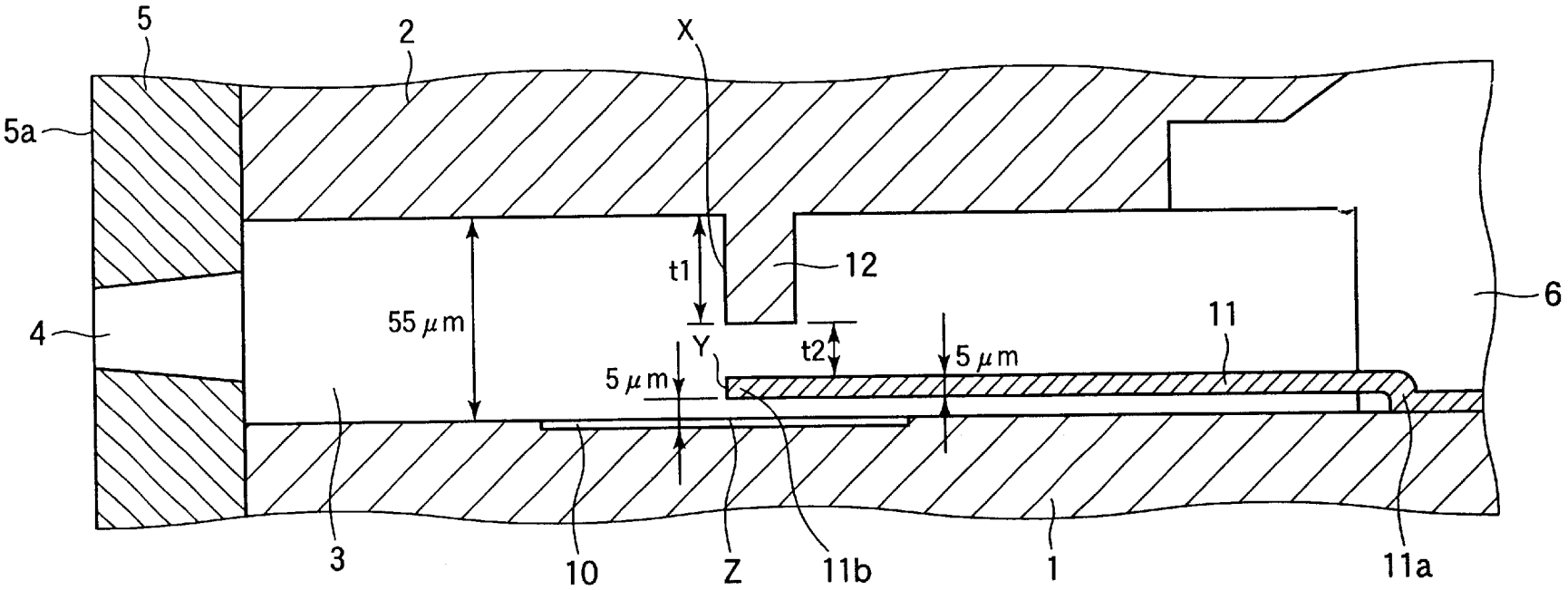
FIG. 1 is a schematic cross-sectional view of a first embodiment, or a liquid discharge head, of the present invention.

FIG. 1 is a schematic cross-sectional view of major parts of the embodiment, or a liquid discharge head. FIGS. 2A to 2E show a process of liquid discharge from the liquid discharge head in FIG. 1.

Referring now to FIG. 1, the structure of the liquid discharge head will be described below.

The liquid discharge head has an element board 1, a top plate 2, and an orifice plate 5. The element board has a heating element 10, or means for producing bubbles, and a movable member 11. The top plate has a stopper (a restrictor) 12 formed on it. The orifice has a discharge port 4 formed in it.

A flow path 3, through which liquid runs, is formed by bonding the element board 1 and top plate 2 in layers. A plurality of flow paths 3 are formed in parallel with each other for each liquid discharge head. The flow path 3 communicates with a discharge port 4 formed in the lower part of the path (on the left in FIG. 1), through which liquid is discharged. There is a bubble formation region near the interface between the heating element 10 and liquid. A common liquid chamber 6 with a large capacity is formed in the upper part of the flow path 3 (on the right in FIG. 1) so that the chamber communicates with a plurality of flow paths 3 at the same time. The plurality of flow paths 3 branch from the common liquid chamber 6. The chamber has a height larger than that of the flow path 3.

The movable member 11 is like a cantilever. The member is secured to the element board 1 up the ink (liquid) flow. Part of the member down a support 11*a* can move up and down with respect to the element board 1. The movable member 11 is initially positioned in substantially parallel with the element board 1 with a clearance kept between the member and element board 1.

The movable member 11 is disposed on the element board 1 so that the free end 11*b* of the member is placed nearly in the center of the heating element 10. The stopper 12, which is on the top plate 2, restricts the upward travel of the free end 11*b* when the free end 11b of the movable member 11 comes into contact with the stopper 12. When the movable member 11 is in contact with the stopper 12 so that its travel is restricted, the movable member 11 and stopper 12 substantially separate a part of the flow path 3 upstream from the movable member 11 and stopper 12 from a part of the flow path downstream from the movable member 11 and stopper 12.

The surface Y of the free end 11b and the end X of the stopper 12 are preferably placed on a plane at right angles to the element board 1. It is also preferable that the surface Y and end X be placed on the plane together with the center Z of the heating element 10.

The flow path 3 is shaped so that the height of its part 3 down the stopper 12 sharply increases. This design allows a bubble down the bubble formation region to smoothly direct liquid toward the discharge port 4. This is due to the fact that even when the stopper 12 restricts the travel of the movable member 11, the flow path has a sufficient height, so that the path does not prevent the bubble from growing. In addition, liquid is discharged properly because pressure unevenness decreases in the direction from the lower end of the discharge port 4 toward its upper end. If a conventional liquid discharge head, which has no movable member 11, uses such a flow path as described above, a bubble easily stays in part of the flow path down the stopper 12. The conventional liquid discharge head is not preferable. In contrast, the effect of a bubble stay is significantly reduced in the embodiment because liquid flows through part of the flow path down the stopper.

Across the stopper 21, the ceiling sharply elevates on the side of the common liquid chamber 6. If this design does not have the movable member 11, discharge pressure is difficult to direct toward the discharge port 4 because the flow resistance down the bubble formation region is lower than the flow resistance up the region. In contrast, the embodiment is adapted so that discharge pressure is positively directed toward the discharge port 4 because the movable member 11 substantially prevents a bubble from moving toward the bubble formation region when a bubble forms. The embodiment is also adapted so that ink is rapidly supplied to the bubble formation region because the flow resistance up the bubble formation region is low.

The design makes upstream bubble growth less than downstream bubble growth, thus inhibiting liquid from moving upstream. Thus meniscus withdrawal decreases after discharge, and the distance which the meniscus travels beyond the orifice surface (liquid discharge surface) 5*a* decreases accordingly. As a result, meniscus vibration is restricted, resulting in stable discharge at low to high vibration frequencies.

In the embodiment, part of the flow path between the lower part of a bubble and the discharge port 4 is parallel to a liquid flow, that is, has a "straight communication" structure. It is more preferable that the direction of propagation of pressure waves produced during bubble formation be made in line with the direction of a liquid flow and that of liquid discharge to ideally stabilize conditions of discharge droplets 66, described later, such as the direction of discharge and discharge velocity at an extremely high level. For the embodiment, a possible way to provide such ideally stabilized conditions is to make the discharge port 4 in line with the heating element 10, especially the discharge port 4 side (downstream side) of the heating element 10 which greatly affects the discharge port 4 side of a bubble. This, in turn, means that the heating element 10, especially its downstream side can be observed from outside the discharge port 4 if there is no liquid in the flow path 3.

Component dimensions will be described below.

In the course of the present invention, examining bubble spread over the top of the movable member (bubble spread up the bubble formation region) showed that adjusting the relationship between the velocity of the movable member and bubble growth rate (in other words, liquid velocity) prevents a bubble from spreading over the top of the member, thus providing good discharge characteristics.

The present invention restricts movable-member displacement using the restrictor to prevent a bubble from spreading over the top of the movable member, thus providing good discharge characteristics when both volume change rate of a bubble and displacement volume change rate of the movable member are on the increase.

Referring now to FIGS. 2A to 2E, the present invention will be described in detail below.

Figure 2A:
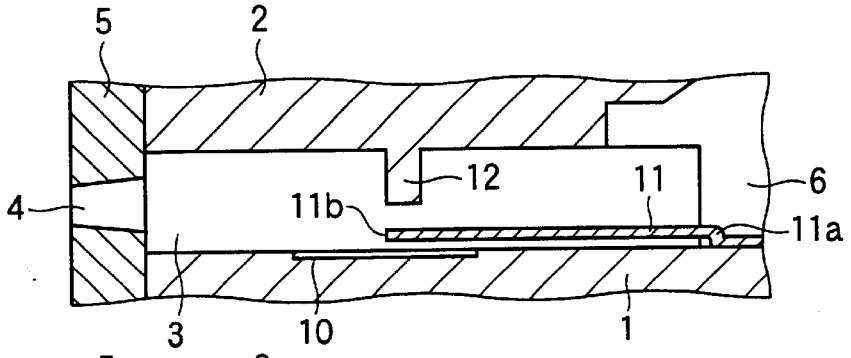
FIGS. 2A, 2B, 2C, 2D and 2E illustrate processes of discharging liquid from the liquid discharge head in FIG. 1.
Figure 2B:
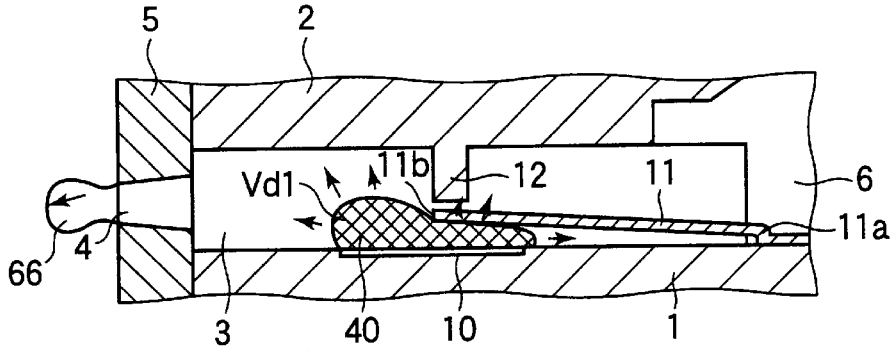

When a bubble forms on the heating element 10 in the environment as illustrated in FIG. 2A, a pressure wave is instantly produced, causing liquid around the heating element 10 to move, so that the bubble 40 grows. At the beginning, the movable member 11 moves up, following liquid (FIG. 2B). As time goes by, reduced liquid inertia and the elasticity of the movable member 11 sharply reduce the velocity of the movable member 11. In contrast, liquid velocity does not sharply decreases. Thus, the difference between the velocities of the movable member 11 and liquid is large. If the clearance between the movable member 11 (free end 11*b*) and the stopper 12 still remains wide, liquid flows through the clearance upstream of the bubble formation region. As a result, it is made difficult for the movable member 11 to come in contact with the stopper 12, and discharge power is lost in part. In this case, the restrictor (stopper 12) does not effectively restrict displacement of the movable member 11.

To solve this problem, the embodiment is adapted to restrict movable member displacement using the restrictor when the movable member nearly follows liquid. Here the velocity of the movable member and the rate of bubble growth (liquid velocity) are referred to as the "rate of movable-member displacement volume change" and "rate of bubble volume change," respectively for convenience. The "rate of movable-member displacement volume change" and "rate of bubble volume change" are a differentiated movable-member volume change and a differentiated bubble volume, respectively.

Such a design substantially eliminates a liquid flow which causes a bubble to spread over the top of the movable member 11 and allows the bubble formation region to be sealed more securely, thus providing good discharge characteristics.

According to such a design, a bubble 40 continues to grow even after the stopper 12 restricts displacement of the movable member 11. To promote free growth of the lower part of the bubble 40, it is preferable that part of the flow path 3 down the stopper 12 be high enough.

For the purpose of the present invention, restriction of movable-member displacement by the restrictor means that the rate of movable-member displacement volume change is zero or negative.

The flow path 3 is 55 $\mu$m high. The movable member is 5 $\mu$m thick. The clearance between the bottom of the movable member 11 and the top of the element board 1 is 5 μm wide when no bubble forms (the movable member 11 does not move).

The distance between the bottom of the top plate 2 and the end of the stopper 12 is denoted by $t_1$, and the clearance between the top of the movable member 11 and the end of the stopper 12 is denoted by $t_2$. When $t_1$ is 30 μm or more, setting $t_1$ to 15 μm or less provides stable discharge characteristics.

Figure 2C:
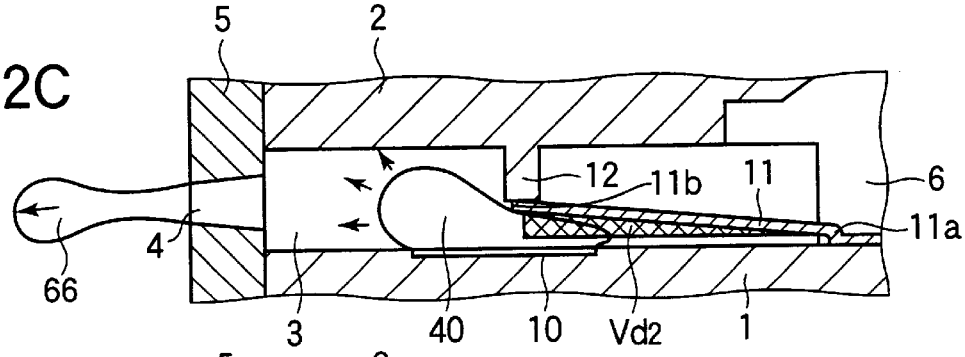
Figure 2D:
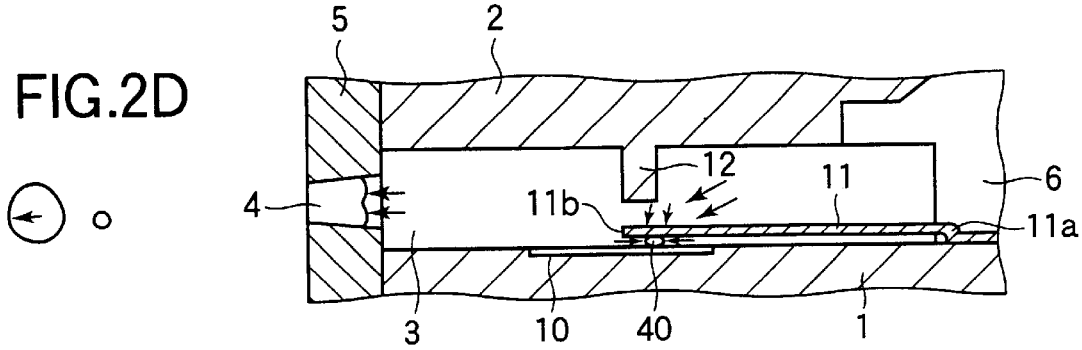
Figure 2E:
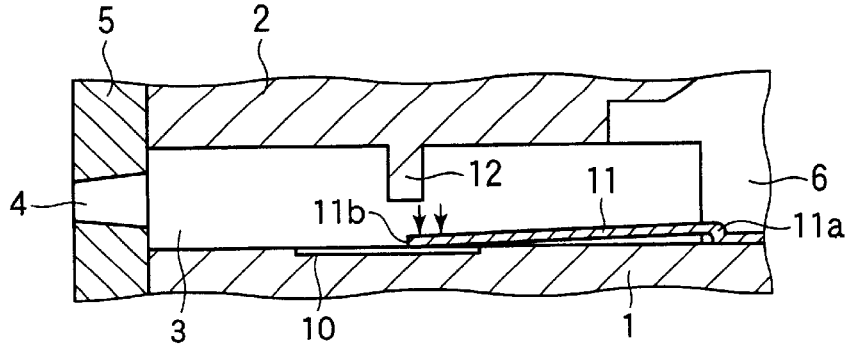
Figure 3:
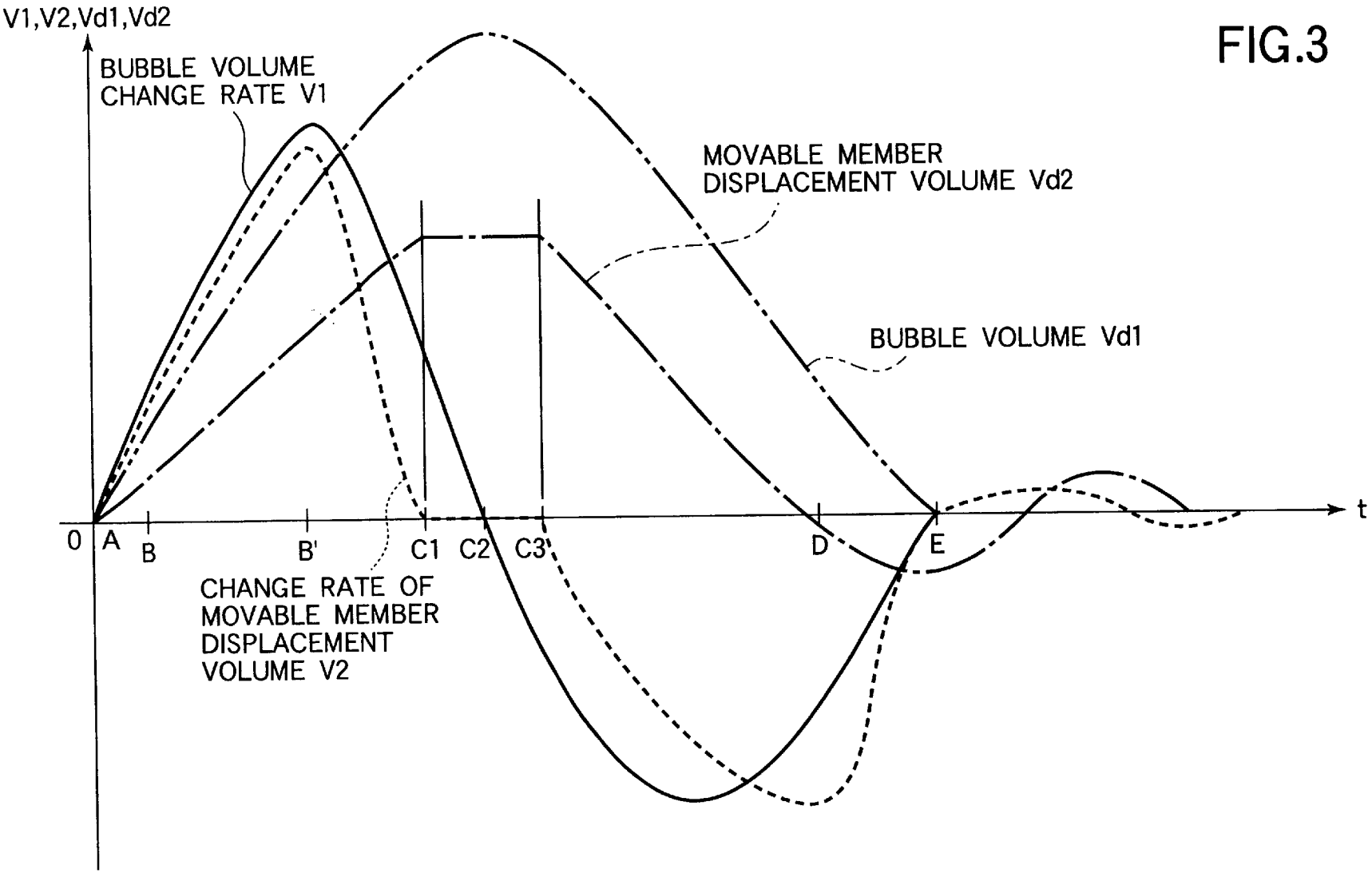
FIG. 3 is a graph of bubble velocity vs. time-dependent changes in bubble volume and a graph of movable member velocity vs. time-dependent changes in movable-member displacement volume.

Referring now to FIGS. 2A to 2E and FIG. 3, discharge from the liquid discharge head will be described in detail below. FIG. 3 is a graph of-bubble velocity vs. time-dependent changes in bubble volume and a graph of movable member velocity vs. time-dependent changes in movable-member displacement volume.

In FIG. 3, the rate of bubble volume change, $V_1$; the bubble volume $V_{d1}$; the rate of movable-member displacement volume change, $V_2$; and the movable-member displacement volume $V_{d2}$ are represented by a solid line, a phantom line, a dashed line, and a chain line, respectively. The rate of bubble volume change, $V_1$, assumes the sign of an increase in the bubble volume $V_{d1}$ to be positive; the bubble volume $V_{d1}$ assumes a volume increase to be positive; the rate of movable-member displacement volume change, $V_2$, assumes the sign of an increase in the movable-member displacement volume $V_{d2}$ to be positive; and the movable-member displacement volume $V_{d2}$ assumes the sign of a volume increase to be positive. Because the sign of the movable-member displacement volume $V_{d2}$ is positive when the movable member 11 moves from its position in FIG. 2A toward the top plate 2, the movable-member displacement volume $V_{d2}$ takes a negative value when the movable member 11 moves from its initial position toward the element board 1 side.

FIG. 2A shows the heating element 10 as observed before energy, such as electric energy, is not applied to it, that is, it does not produce heat. As described later, the movable member 11 is positioned opposite to the upper part of a bubble formed by heat generated by the heating element 10.

In FIG. 3, the state described above corresponds to point A where t=0.

FIG. 2B shows that the bubble 40 starts to form, accompanied by film boiling when part of liquid filling the bubble formation region is heated by the heating element 10. In FIG. 3, this state corresponds to the interval between point B and a point immediately in front of point $C_1$. The figure shows that the bubble volume $V_{d1}$ increases with time. The movable member starts to move after the volume of the bubble 40 changes. Namely, when a pressure wave due to the bubble 40 formed through film boiling is propagated through the flow path 3, liquid moves upstream and downstream of the center of the bubble formation region, and the movable member 11 starts to move due to an upstream flow involved in growth of the bubble 40. Liquid also flows upstream between the walls of the flow path 3 and movable member 11 toward the common liquid chamber 6. The clearance between the stopper 12 and movable member 11 decreases as the movable member 11 moves. In these circumstances, a discharged droplet 66 starts to be discharged from the discharge port 4.

FIG. 2C shows that as the bubble 40 further grows, the movable member 11 moves, so that the free end 11*b* of the movable member 11 comes in contact with the stopper 12. In FIG. 3, this state corresponds to the interval between points $C_1$ and $C_3$.

The rate of movable-member displacement volume change, $V_2$, sharply decreases when the state in FIG. 2B changes to that in FIG. 2C where the movable member 11 is in contact with the stopper 12. That is, the rate $V_2$ rapidly lowers at point B' between point B and point $C_1$ in FIG. 3. This is because liquid flow resistance sharply increases immediately before the movable member 11 comes in contact with the stopper 12. The rate of bubble volume change, $V_1$, also sharply decreases as the rate of movable-member displacement volume change, $V_2$, does.

Then the movable member 11 further approaches the stopper 12 until the member comes in contact with the stopper. The contact between the movable member 11 and the stopper 12 is ensured by limiting the height of the stopper 12, $t_1$, and the clearance between the top of the movable member 11 and the end of the stopper 12 as described above. Once the movable member 11 comes in contact with the stopper, the member is prevented from further moving up (the interval between points $C_1$ and $C_3$). Thus upstream liquid flow is significantly limited, and accordingly, upstream growth of the bubble 40 is limited. However, power of upstream liquid flow is so large that the movable member 11 undergoes upstream stress, slightly warping upward. It is true that the bubble 40 continues to grow, but it grows downstream because the stopper 12 and movable member 11 prevent the bubble from growing upstream. Thus the bubble 40 more vigorously grows upward downstream of the heating element 10 than when the movable member 11 is not provided. As shown in FIG. 3 the rate of movable-member displacement volume change, $V_2$, is zero between points $C_1$ and $C_3$ because the movable member 11 is in contact with the stopper 12. However, because the bubble 40 grows downstream, it continues to grow until point $C_2$ is reached which comes slightly after point $C_1$. At point $C_2$, the bubble volume $V_{d1}$ is maximized.

On the other hand, since the movement of the movable member 11 is restricted by the stopper 12 the upper part of the bubble 40 is small to the extent that the part only warps the movable member 11 upward using the inertia of upstream liquid flow to stress the member. The stopper 12, flow path side walls, movable members 11, and support 11*a* almost completely prevent the upper part from propagating upstream.

Such a design significantly reduces upstream liquid flow to prevent liquid backflow and pressure vibration in a feed system which impede erroneous liquid flow into adjacent flow paths and fast refilling.

FIG. 2D shows that after film boiling, described above, negative pressure in the bubble 40 overcomes downstream liquid flow in the flow path 3, so that the bubble 40 starts to shrink.

As the bubble 40 shrinks (the interval between points $C_2$ and point E in FIG. 3), the movable member 11 moves down (the interval between points $C_3$ and point D in FIG. 3). The movable member 11 accelerates downward under stress caused by the member itself as a cantilever and an upward warp as described above. Because of low flow resistance in the flow resistance region formed between the common liquid chamber 6 and flow path 3 upstream of the movable member 11, a downstream liquid flow rapidly increases and passes the stopper 12 into the flow path 3. As a result, liquid in the common liquid chamber 6 is introduced into the flow path 3. Liquid introduced into the flow path 3 runs between the stopper 12 and downwardly displaced movable member 11 to flow into a downstream side of the heating element 10 and acts on the bubble 40 not having been completely broken to promote its breakage. Then the liquid runs toward the discharge port 4 to help the meniscus return and increase refilling speed.

In this stage, a liquid pillar consisting of discharged droplets 66 from the discharge port 4 is ejected as liquid droplets to the outside.

As described above, liquid flows between the movable member 11 and the stopper 12 into the flow path 3. This increases flow velocity on the wall on the top plate 2 side, thus minimizing fine-bubble formation on the wall and helping stabilize discharge.

Moreover, points of cavitation occurrence due to bubble breakage shift downstream of the bubble formation region, so that damage to the heating element is reduced. In addition, this phenomenon reduces burn deposits on the heating element in the bubble formation region, thus increasing discharge stability.

FIG. 2E shows that the movable member 11 overshoots from its initial position, moving down after the bubble 40 completely breaks (point E or further in FIG. 3).

The overshoot of the movable member 11, which depends on its rigidity and the viscosity of liquid used, attenuates in a short time until the member returns to the initial position.

Figure 4:
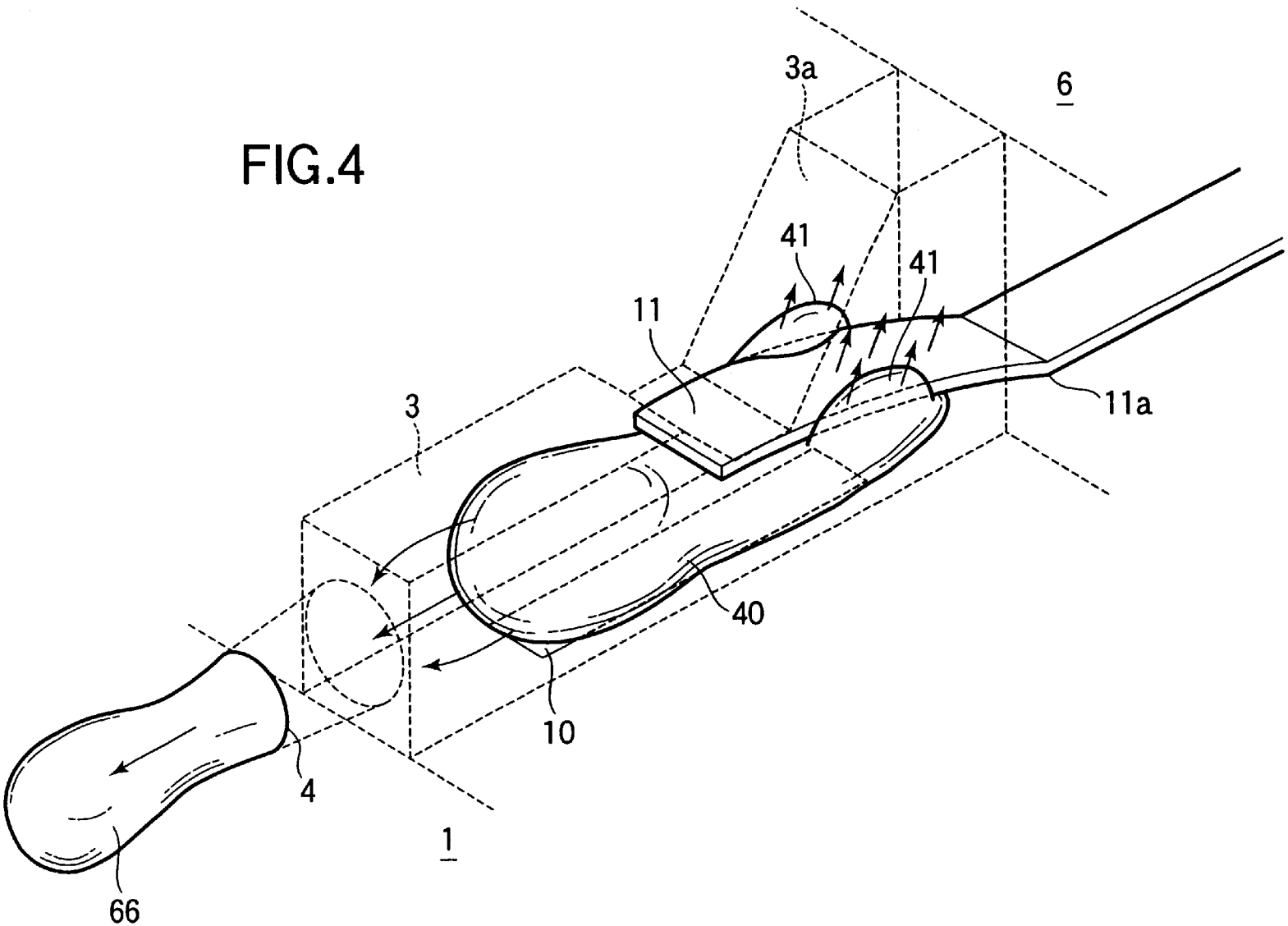
FIG. 4 is a perspective view of part of the liquid discharge head in FIG. 1.

Referring now to FIG. 4, a perspective view of part of the head in FIG. 1, a swelling bubble 41 which swells especially at both ends of the movable member 11 and a meniscus in the discharge port 4 will be described in detail below. The stopper 12 and low-flow resistance region 3*a* upstream of the stopper 12 in FIG. 4 differ in shape from their counterparts in FIG. 1 but has the same basic characteristics.

For the embodiment, there are slight clearances between both side walls constituting the flow path 3 and both sides of the movable member 11. The clearance allows the movable member 11 to move smoothly. In the process of bubble growth due to the heating element 10, the bubble 40 causes the movable member 11 to move. The bubble 40 swells toward the top of the movable member 11 through the clearance to slightly enter the low-flow friction region 3*a*. The swelling bubble 41 spreads over the back of the movable member 11 (the surface opposite to the bubble formation region) to reduce vibration of the movable member 11 and stabilize discharge characteristics.

In the process of breakage of the bubble 40, combined with the high speed meniscus withdrawal from the discharge port 4 described above, the swelling bubble 41 prompts liquid to flow from the low-flow resistance region 3*a* to the bubble formation region, thus completing bubble breakage fast. Especially, a liquid flow caused by the swelling bubble 41 almost completely prevents bubbles from staying at the corners of the movable member 11 and flow path 3.

The discharge droplet 66 is like a liquid pillar with a round end the instant it is discharged through the discharge port 4 from a liquid discharge head as described above due to formation of the bubble 40. Such is also the case with a conventional head. In this embodiment, when the movable member 11 moves due to bubble growth and then comes in contact with the stopper 12, the flow path 3, which has the bubble formation region, is substantially closed except for the discharge port thereof. If the bubble is broken when the flow path is substantially closed, the path is kept closed until the movable member 11 moves away from the stopper 12 due to bubble breakage. Thus most energy for breaking the bubble 40 serves to move liquid near the discharge port 4 upstream. As a result, immediately after the bubble 40 starts to break, the meniscus is rapidly withdrawn from the discharge port 4 into the flow path 3, so that the meniscus separates with a strong force a tail which forms a liquid pillar together with the discharge droplet 66 outside the discharge port 4. This makes satellite dots, formed from the tail, smaller, thus improving print quality.

Because the meniscus does not continue to draw the tail endlessly, discharge speed does not decrease. In addition, satellite dots are withdrawn due to the so-called strip stream phenomenon behind the discharge droplet 66 because the distance between the satellite dots and the discharge droplet 66 is reduced. As a result, the discharge droplet 66 and a satellite dot can combine together, thus allowing a liquid discharge head almost free from satellite dots to be provided.

Furthermore, according to this embodiment, in the above mentioned liquid discharge head, the movable member 11 is installed to restrain the bubble 40 from growing only up a liquid flow leading to the discharge port 4. It is preferable that the free end 11*b* of the movable member 11 be substantially positioned in the center of the bubble formation region. Such a design allows an upstream back wave due to bubble growth on one hand and liquid inertia on the other hand, which are not directly related to liquid discharge, to be limited and the bubble 40 to directly grow downstream, or toward the discharge port 4.

The low-flow resistance region 3*a* is opposite to the discharge port 4 with the stopper 12 in between. The flow resistance of the region 3*a* is so low that upstream liquid movement due to growth of the bubble 40 forms a good flow. Thus when the movable member 11 comes in contact with the stopper 12, the member element 11 undergoes such a stress that the member is pulled upstream. As a result, a large force due to growth of the bubble 40 remains, which force moves liquid upstream. While the repulsive force of the movable member 11 overcomes the large force, the flow path can be kept closed as described above. That is, this design ensures that the meniscus is withdrawn fast. When the repulsive force of the movable member 11 becomes larger than the force of the liquid moving upstream due to the bubble growth as the breakage of the bubble 40 advances the movable member 11 moves down back to the initial position, and a downstream flow occurs in the low-flow resistance region 3*a* also. The flow resistance of the region 3*a* is low so that the liquid forms rapidly a good downstream flow, thus running by the stopper 12 into the flow path 3. As a result, downstream liquid movement toward the discharge port 4 allows the meniscus to stop rapidly and meniscus vibration to end fast.

Figures 5A, 5B, 5C, 5D, 5E, 5F, 5G, 5H, 5I, 5J, 5K:
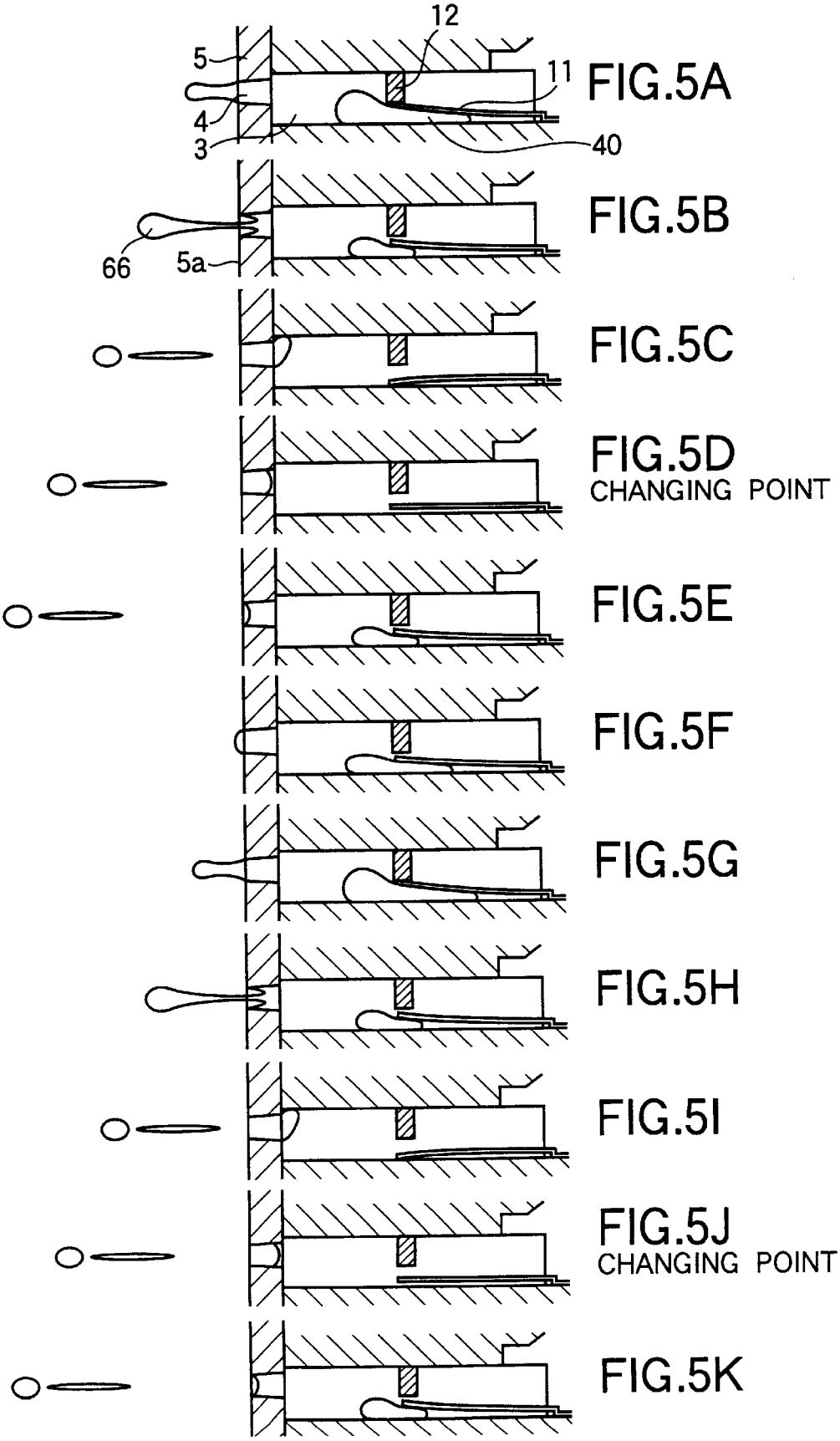
FIGS. 5A, 5B, 5C, 5D, 5E, 5F, 5G, 5H, 5I, 5J and 5K illustrate steps of continuous discharge from the liquid discharge head in FIG. 1.
Figure 6:
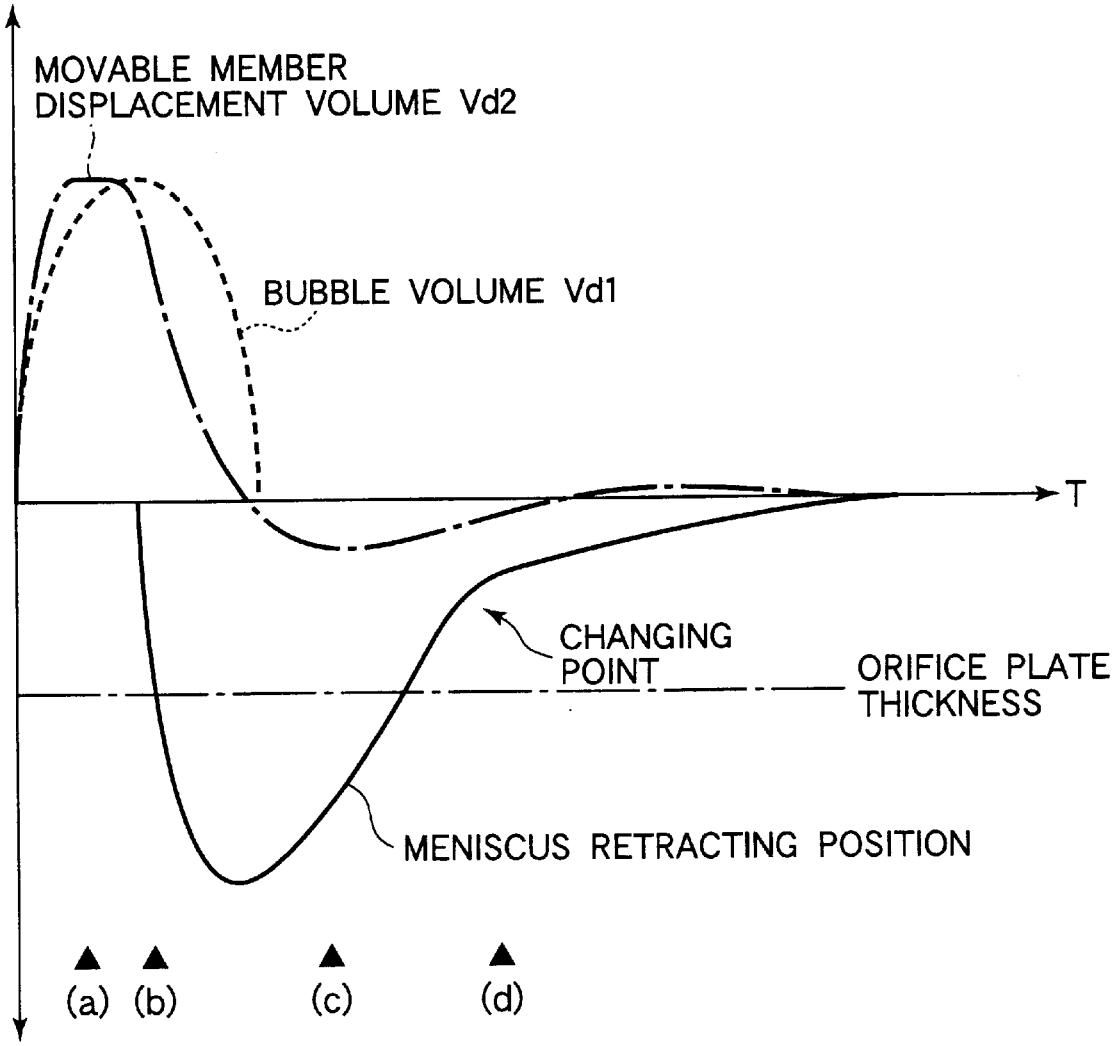
FIG. 6 shows a change in meniscus withdrawal position in the first step of continuous discharge in FIGS. 5A to 5K.
Figure 7A:
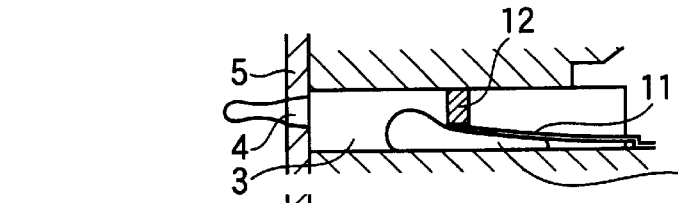
FIGS. 7A, 7B, 7C, 7D, 7E, 7F, 7G, 7H, 7I, 7J and 7K illustrate steps of continuous discharge from a comparative liquid discharge head concerning the present invention.

A liquid discharge head according to the present invention features a design that allows ink to be discharged in sequence at short time intervals. Referring now to FIGS. 5A through 5K to FIG. 8, sequential ink discharge using the embodiment, or the liquid discharge head, will be described, taking meniscus behavior into account. FIGS. 5A through 5K are schematic cross-sectional views illustrating steps of sequential liquid discharge using the liquid discharge head. FIG. 6 is a graph showing meniscus behavior for a first liquid discharge. In FIG. 6, the bubble volume $V_{d1}$, movable-member displacement volume $V_{d2}$, and meniscus withdrawal position are represented by a dashed line, a chain line, and a solid line, respectively. In FIG. 6 also, positions corresponding to the thickness of an orifice plate are represented by horizontal chain lines. Positions corresponding to the states in FIGS. 5A through 5K are under the graph in FIG. 6. FIGS. 7A through 7K and FIG. 8 illustrate steps of sequential liquid discharge using a comparative example, or a liquid discharge head with an orifice plate which is thinner, compared with the embodiment. FIGS. 7A through 7K and FIG. 8 correspond to FIGS. 5A through 5K and FIG. 6, respectively. FIGS. 6 and 8 show meniscus behavior as observed when the liquid discharge heads are let to stand, a second discharge being not performed. FIGS. 5A through 5K and FIGS. 7A through 7K contain a discharge port which is upwardly off the center of a nozzle. For ease of understanding, FIGS. 5A through 5K and FIGS. 7A through 7K are overdrawn.

When the heating element 10 is driven to start a first discharge, the movable-member displacement volume $V_{d2}$, increases with the bubble volume $V_{d1}$. When the movable member 11 rests against the stopper 12 as shown in FIGS. 5A and 7A, the movable-member displacement volume $V_{d2}$ becomes constant. The bubble 40 continues to grow downstream, so that the bubble volume $V_{d1}$ increases. In the meantime, ink is ejected through the discharge port 4 to form the discharge droplet 66.

Figure 7B:
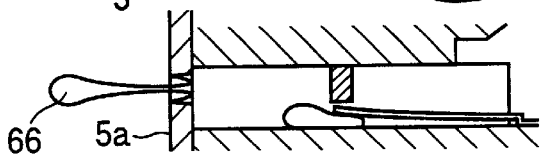
Figure 7C:
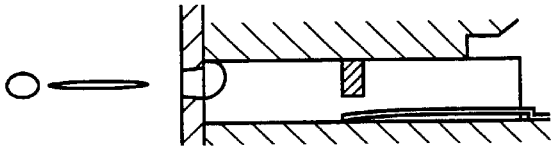

When bubble breakage starts after the bubble volume $V_{d1}$ maximizes, the meniscus starts to withdraw as shown in FIGS. 5B and 7B. The discharge droplet 66 is separated from ink in the liquid discharge head and discharged. In this step, a tail due to surface tension is also separated, so that satellites may be formed as shown in FIG. 5C through 5E and FIGS. 7C through 7E. Because these satellites are discharged in substantially the same direction as main droplets, the satellites do not adversely affect print quality.

When the bubble breaks, the movable member 11 moves down until it is below the normal position. This causes the head to be rapidly refilled with ink, and the meniscus returns fast. Because the discharge port is shifted upward, flow resistance is higher near the walls of the flow path 3 than in the center of the path. Thus liquid flows faster on the downside than on the upside. This causes the meniscus to be inclined so that its downside is positioned downstream, i.e., the meniscus is not parallel to the orifice surface 5*a*.

Figure 7D:
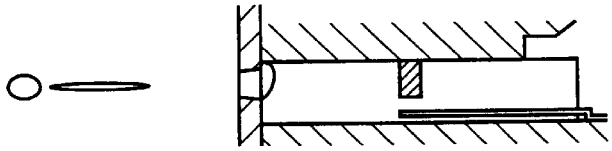
Figure 8:
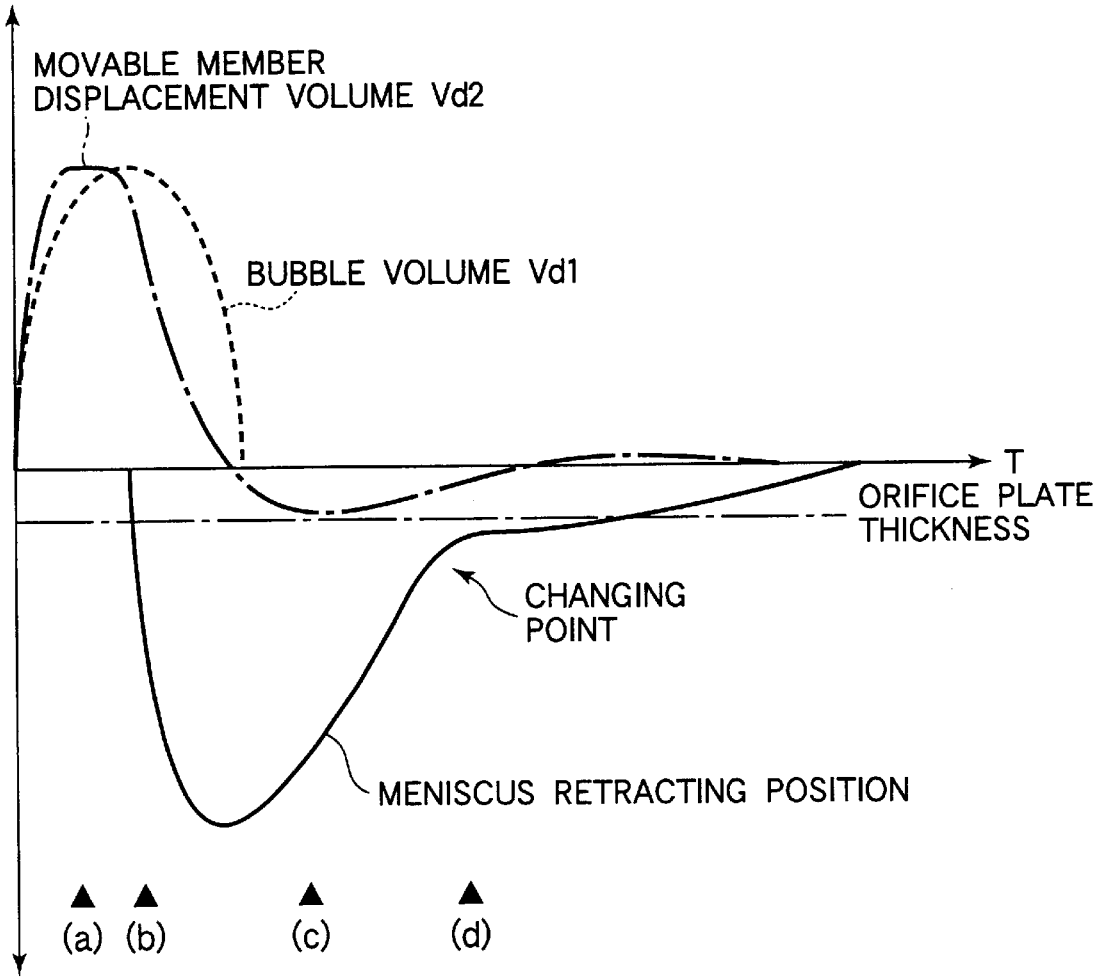
FIG. 8 shows a change in meniscus withdrawal position in the first step of continuous discharge in FIGS. 7A to 7K.

Then the movable member 11 returns nearly to the normal position as shown in FIGS. 5D and 7D, thus causing flow resistance on the stopper to increase. As a result, meniscus return slows down, and a changing point appears on the meniscus withdrawal position curve.

In the embodiment, or the liquid discharge head, the meniscus goes back into the discharge port 4 as shown in FIG. 5D. When the meniscus reenters the discharge port 4, the effect of surface tension grows because the discharge port 4 has a larger cross-sectional area in a plane perpendicular to the direction of the ink introduction than that of the flow path 3. When a one-sided refilling flow nearly breaks, surface tension has a relatively considerable effect, so that the meniscus is substantially parallel to the orifice surface 5*a* again. On the other hand, in the comparative liquid discharge head with a relatively thin orifice plate, the meniscus is still in the flow path 3, which meniscus remains inclined for a relatively long time as shown in FIG. 7D.

Figure 7E:
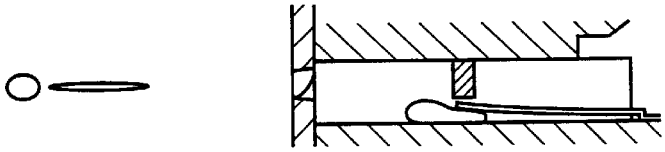
Figure 7F:
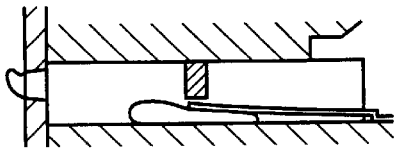
Figure 7G:
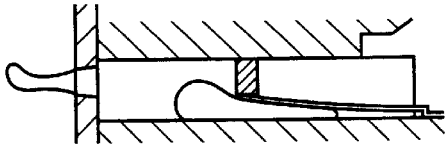
Figure 7H:
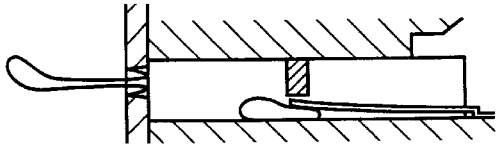
Figure 7I:
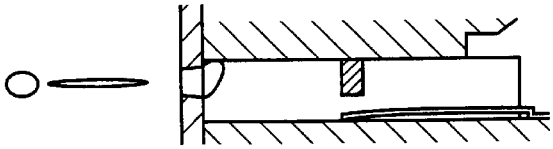
Figure 7J:
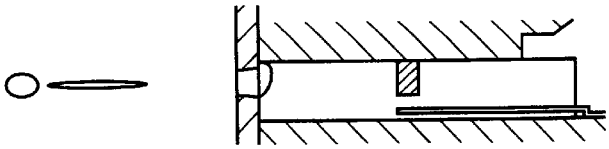
Figure 7K:
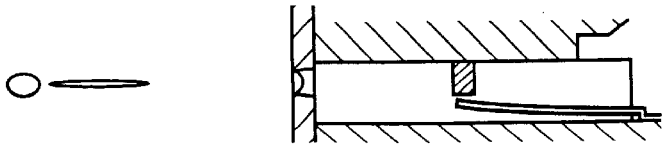

When the comparative liquid discharge head performs a second discharge, ink is pushed into the discharge port with the meniscus inclined, as shown in FIG. 7E. As shown in FIGS. 7F and 7G, a relatively high pressure is applied to ejected ink on the downside. Thus, as shown in FIGS. 7B through 7K the direction of ink discharge inclines upward, so that it shifts from an orifice axis determined by the orifice surface 5*a* and the direction of the opening of the discharge port 4. Satellites, which are formed following main droplets, are not affected by the inclination of the meniscus, thus flying without shifting from the orifice axis. Thus for the comparative liquid discharge head, a pixel formation position shifts, and main droplets and satellites reach different points, so that the quality of a formed image deteriorates.

In contrast, the embodiment, or the liquid discharge head, can perform a second ink discharge as properly as a first ink discharge as shown in FIGS. 5E through 5K because the meniscus is substantially parallel to the orifice surface 5*a* again in the discharge port 4.

To perform a second discharge with no effect of meniscus inclination using the comparative liquid discharge head, it is desired that ink be discharged after the meniscus reenters the discharge port 4. However, the head is only slowly refilled with ink after the inflection point is passed because upstream flow resistance is high as described above. Because meniscus surface tension mainly causes the liquid discharge head to be refilled with ink after an ink flow becomes weak, the cross-sectional area of the meniscus is relatively large when the meniscus is in the flow path 3. Thus force attracting ink, which is due to surface tension, is relatively weak, so that the meniscus moves back more slowly than when it is in the discharge port 4 as shown in FIG. 8. This makes it difficult to drive the comparative liquid discharge head at high speed. In contrast, the embodiment is adapted so that high-speed driving is possible.

As described above, the embodiment, or the liquid discharge head, is designed so that the meniscus is in Ad the discharge port when the inflection point is reached, at which the movable member 11 returns to the normal position after ink is discharged, thus changing meniscus speed. Such a design allows ink to be discharged properly at short time intervals by performing the next ink discharge by the time the meniscus reaches the orifice surface 5*a* from the position corresponding to the inflection point. As a result, the liquid discharge head can be driven at high speed. At the inflection point, the meniscus can be placed in the discharge port 4 by adjusting design conditions, such as the size and shape of the movable member 11, flow path 3, discharge port 4, and orifice plate 5, especially by adjusting the thickness of the orifice plate 5.

<Liquid discharge apparatus>

Figure 9:
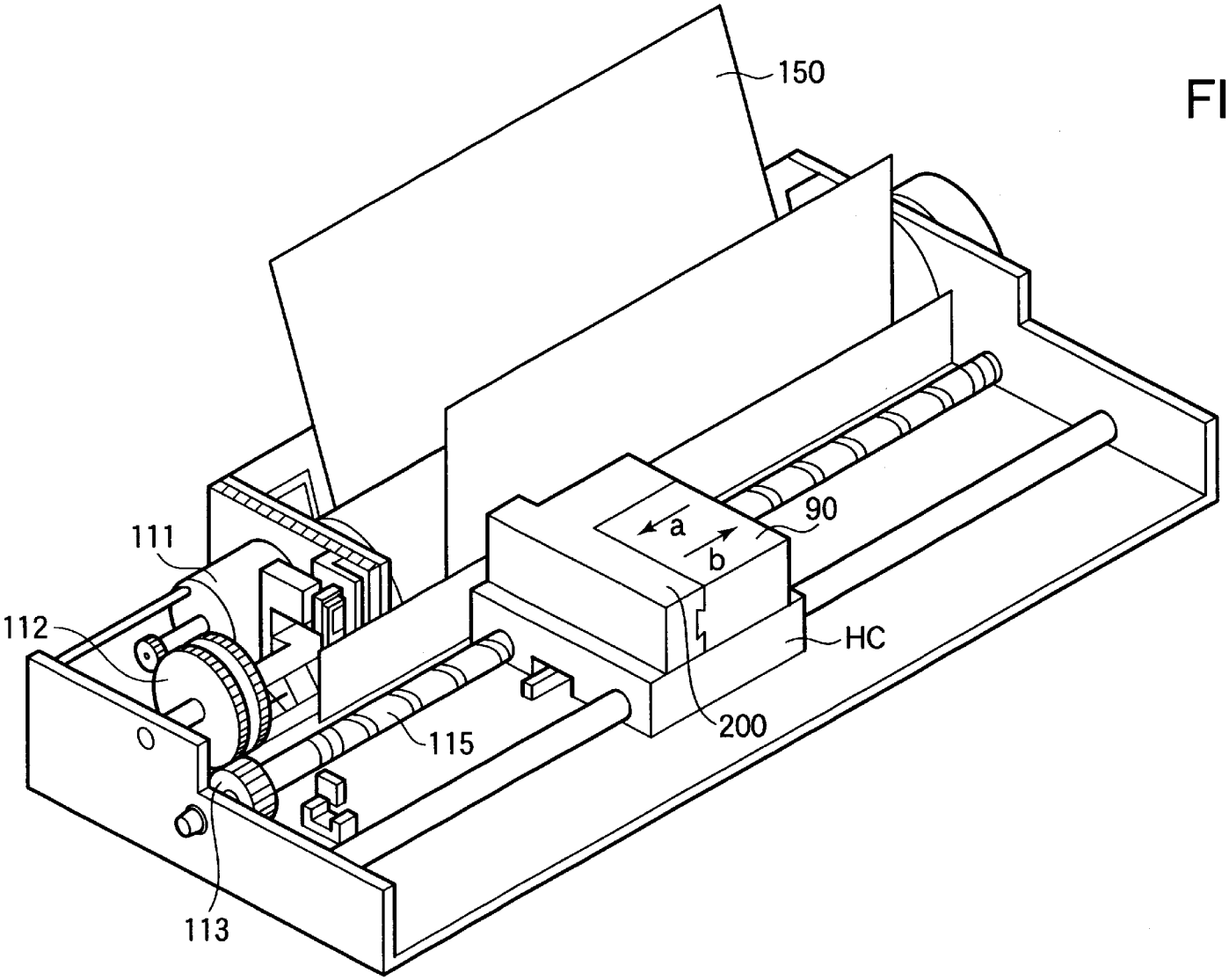
FIG. 9 shows a rough structure of a liquid discharge apparatus incorporating a liquid discharge head of the present invention.

FIG. 9 shows a rough structure of a liquid discharge apparatus containing the embodiment, or the liquid discharge head, designed as described above. Especially an liquid discharge recorder that uses ink as discharge liquid will be described below. The liquid discharge head has a carriage head cartridge in which an ink tank 90 holding ink and a liquid discharge head 200 can removably be installed. The cartridge reciprocates over the width of a recording medium conveyed by recording medium conveying means 150, such as paper.

When drive signal feed means, not shown, feeds a drive signal to liquid discharge means on a carriage, recording liquid is ejected from the liquid discharge head against the recording medium in response to the signal.

The liquid discharge apparatus has a motor 111, or a drive source which drives the recording medium conveying means and carriage; a gears 112 and 113 which transmit power from the drive source to the carriage; a carriage shaft 115; and so on. The liquid discharge apparatus and a method by which the discharger discharges liquid allow a good image to be recorded by ejecting liquid against a variety of recording media.

What is claimed is:

1. A liquid discharge head, comprising: a heating element which heats liquid in a liquid flow path to produce a bubble in the liquid; a discharge port through which liquid is discharged by pressure involved in bubble growth, the discharge port communicating with the lower part of the liquid flow path and being smaller in the area of a cross section at right angles to the direction of liquid introduction than the liquid flow path; a movable member which is provided like a cantilever in the liquid flow path, the free end of the member being positioned on the side of the discharge port; and a restrictor which substantially closes the upper part of the liquid flow path by being substantially brought into contact with the movable member when the movable member is displaced by the growth of the bubble, wherein a meniscus is in the discharge port when due to bubble breakage, the movable member moves from the normal position in such a direction that the liquid flow path is open widely and then returns to the normal position.

2. A liquid discharge head, comprising: a heating element which heats liquid in a liquid flow path to produce a bubble in the liquid; a discharge port through which liquid is discharged by pressure involved in bubble growth, the discharge port communicating with the lower part of the liquid flow path and being smaller in the area of a cross section at right angles to the direction of liquid introduction than the liquid flow path; a movable member which is provided like a cantilever in the liquid flow path, the free end of the member being positioned on the side of the discharge port; and a restrictor which substantially closes the upper part of the liquid flow path by being substantially brought into contact with the movable member when the movable member is displaced by the growth of the bubble, wherein when liquid is discharged, the position of the meniscus significantly varies, and then the rate of positional variation sharply decreases, starting at a certain position when the meniscus is in the discharge port.

3. The liquid discharge head according to claim 2, wherein the liquid discharge head have means for controlling the heating element, and the means controls the heating element so that the next liquid discharge is performed by the time that the meniscus reaches the liquid discharge surface after the rate of positional variation sharply changes.

4. A liquid discharge apparatus, comprising: the liquid discharge head according to any of claims 1 to 3; and recording medium conveying means for conveying a recording medium which receives liquid discharged from the liquid discharge head.

5. The liquid discharge apparatus according to claim 4, wherein recording is carried out by discharging liquid from a liquid discharge head to attach ink to a recording medium.

6. A liquid discharging method, comprising the steps of producing a bubble in liquid by heating the liquid, moving a cantilever-like movable member in the path when the normal position as the bubble grows, substantially closing the upper part of a liquid flow path when the bubble attains the maximum volume, discharging liquid through a discharge port which is smaller in the area of a cross section at right angles to the direction of liquid introduction than the liquid flow path by pressure involved in bubble growth, and returning the movable member to the normal position when the bubble breaks after liquid is discharged, wherein a meniscus is in the discharge port when the movable member returns to the normal position after the member moves from the normal position to the heating element side due to bubble breakage, and the next liquid discharge is performed during the period from the time when the movable member returns to the normal position to the time when the meniscus reaches the liquid discharge surface.

7. A liquid discharging method, comprising the steps of producing a bubble in liquid by heating the liquid, moving a cantilever-like movable member in the path from the initial position as the bubble grows substantially closing the upper part of a liquid flow path when the bubble attains the maximum volume, discharging liquid through a discharge port which is smaller in the area of a cross section at right angles to the direction of liquid introduction than the liquid flow path by pressure involved in bubble growth, and returning the movable member to the initial position when the bubble breaks after liquid is discharged, wherein when liquid is discharged, the position of the meniscus significantly varies, then the rate of positional variation sharply decreases, starting at a certain position when the meniscus is in the discharge port, and the next liquid discharge is performed by the time that the meniscus reaches the liquid discharge surface after the rate of positional variation sharply changes.

* * * * *

UNITED STATES PATENT AND TRADEMARK OFFICE

CERTIFICATE OF CORRECTION

PATENT NO. : 6,409,319 B1
DATED : June 25, 2002
INVENTOR(S) : Yoichi Taneya et al.

It is certified that error appears in the above-identified patent and that said Letters Patent is hereby corrected as shown below:

Column 1,
Line 39, “mainly” should be deleted.

Column 2,
Line 10, “relatively,” should read -- relative, --; and
Line 42, “invention” should read -- invention is employed, --.

Column7,
Line 11, “of-bubble” should read -- of bubble --.

Column 12,
Line 18, “Ad” should be deleted.

Column 13,
Line 29, “have” should read -- has --.

Signed and Sealed this

Fourteenth Day of January, 2003

JAMES E. ROGAN
*Director of the United States Patent and Trademark Office*